United States Patent [19]

Leinhaas

[11] Patent Number: 4,850,272

[45] Date of Patent: Jul. 25, 1989

[54] ARTICULATED-LEVER CUTTING AND FORMING PRESS

[75] Inventor: Werner Leinhaas, Geinhausen, Fed. Rep. of Germany

[73] Assignee: E. Bruderer Maschinenfabrik AG, Switzerland

[21] Appl. No.: 163,822

[22] PCT Filed: Jun. 17, 1987

[86] PCT No.: PCT/EP87/00315

§ 371 Date: Feb. 22, 1988

§ 102(e) Date: Feb. 22, 1988

[87] PCT Pub. No.: WO87/07870

PCT Pub. Date: Dec. 30, 1987

[30] Foreign Application Priority Data

Jun. 20, 1986 [EP] European Pat. Off. ..... 86108482.0

[51] Int. Cl.[4] ..... B30B 1/10

[52] U.S. Cl. ..... 100/286; 100/272; 100/257; 83/530; 83/624; 83/630; 72/451

[58] Field of Search ..... 100/257, 272, 281, 286; 83/530, 624, 626, 630, 639; 72/451

[56] References Cited

U.S. PATENT DOCUMENTS

| | | | |
|---|---|---|---|
| 2,230,288 | 2/1941 | Dinzel . | |
| 3,926,033 | 12/1975 | Forlchon | 100/272 |
| 3,975,132 | 8/1976 | Keim . | |
| 4,318,325 | 3/1982 | Bareis et al. | 83/630 |

FOREIGN PATENT DOCUMENTS

| | | |
|---|---|---|
| 40962 | 10/1887 | Fed. Rep. of Germany . |
| 1490249 | 7/1967 | France . |
| 2291855 | 6/1976 | France . |
| 2052370 | 1/1981 | United Kingdom . |

*Primary Examiner*—Peter Feldman

*Attorney, Agent, or Firm*—Ostrolenk, Faber, Gerb & Soffen

[57] ABSTRACT

The invention relates to an articulated lever press consisting of a press stand (1.1) and a frame-shaped press slide (2.1), the slide (2.1) possessing a hydraulic cylinder drive (2.12) which is arranged on it and is connected to the multi-articulated support (2.7) guided in the center of the press in the slide (2.1), and at least two connecting rods (2.8) are movably arranged on the said multi-articulated support, the other ends of the said connecting rods each engaging one of the two articulated levers (2.10) or (2.11) which are mounted on the slide (2.1) and on the press frame (1.1) so that their height can be adjusted.

The object is essentially to keep the working range of the slide (2.1) adjustable, irrespective of the slide travel and while maintaining slide guidance.

It is proposed that the press stand (1.1) be a twin-stand frame partially closed even at the front and end. The working range of the slide (2.1) in the stand (1.1) is supported and adjusted by synchronously driven shafts (2.2) which are coordinate with the stand (1.1) via guide beams (2.4) provided with shaft bearings (2.3).

The guide beams (2.4) are provided on the lower surface with bearings (2.3.1) to permit the suspension of the pair of articulated levers (2.10/2.11) which are to be connected to the slides (2.1) and (2.9). (FIG. 2).

11 Claims, 5 Drawing Sheets

ARTICULATED-LEVER CUTTING AND FORMING PRESS

The invention relates to an articulated lever cutting and forming press consisting of a single or multiple press stand and one or more frame-shaped press slide(s) which as a rule is or are closed, the slide or slides possessing—in each case between two symmetrically identical articulated lever systems with their joints bending toward the center of the press—a hydraulic cylinder drive which is arranged on the slide and whose piston is connected, at the end of its piston rod, to the multi-articulated support guided in the center of the press in the slide and has at least two connecting rods being movably arranged on the said support which at the other end engage the articulated lever systems which in turn on the one hand are arranged on the press frame so that their height can be adjusted and on the other hand are rotatably mounted in the slide and directed toward the press table, the hydraulic cylinder drive obeying the relationship that the piston stroke is equal to the path covered by the multi-articulated support minus the slide stroke.

German Patent No. 2,925,416 has disclosed a toggle lever sheet metal cutting press of this type. It has become widely established in practice under the name "differential displacement press" since not only does it have convincing technology, which, inter alia, achieves a substantial reduction in the acceleration forces, but furthermore at least one serious problem of industrial hygiene is reduced by the embodiment described at the outset.

The object of this Patent is based on the fact fthat hydraulic fluid is invariably not completely incompressible and the resulting volume difference is equal to the product of volume under atmospheric pressure × the working pressure and the compression index (about $70 \times 10^{-6}$), to which volume difference it is necessary to add the volume reduction due to the finely dispersed air inclusions frequently present. The result of this is that, when the pressure is suddenly relieved, i.e. when the material to be cut is parted by the slide carrying the cutting tool, the resulting expansion volume is not insignificant and, in cooperation with the elastic expansion behavior of all guide paths of the hydraulic press which are executed under pressure, through expansion and spring mounting of the machine frame and in conjunction with the residual slide movement which is uncontrollable at this moment, leads to the known cutting impact noise, i.e. the "cutting report".

The result obtained according to this Patent means that, when the hydraulic cylinder drive is arranged on the slide, the stroke of the hydraulic cylinder drive is smaller than in the case of a comparable prior art press, in which the hydraulic cylinders are supported on the press stand.

This substantially reduces the hydraulic fluid volume to be transported and subjected to a load at the end of the working process, and hence substantially reduces the possible expansion volume, with the result that the cutting impact noise is greatly reduced in accordance with the object.

Further advantages of an embodiment according to the Patent described at the outset are, inter alia, the repeatability of the hydromechanical drive, which has a tolerance of only ±0.01 mm at bottom dead center, and inevitably lead to the object of widening the field of uses of these presses.

The Patent is based on U.S. Pat. No. 2,037,811 and on British Pat. No. 804,352. In these embodiments, the stroke of the stationary drive cylinder fixed to the frame is determined by the transmission ratio resulting from the toggle lever drive and the type of connecting rods in a conventional manner.

Regarding the form of the stand, reference may be made to Mäkelt, Carl Hanser Verlag Munich 1961, page 33, FIG. 23 ("The mechanical presses"). This publication describes the load and deformation conditions in the closed, rectangular twin-stand frame of a vertical press. This is a statically multiply indeterminate system in which the force P acts at the center of the press support (center of table) and its opposing forces P/2 act at the two crankshaft bearings at a distance W from the axis through the center of gravity of the stand. The greatest sag occurs at the center of the table at the point of action D of the force P.

The relationships arising from these loads with regard to the course of the bending line and the determination of the spring mounting of the frame will not be repeated individually here; instead, it will merely be pointed out that the unsupported length will finally be determined by the actual spring mounting of the frame in conjunction with the given load.

So-called "C frames" cannot generally be used for presses according to the definition given at the outset, since their frame spring mounting greatly influences the accuracy of cutting in presses having a high load capacity.

Taking this into account, it is the object of this invention to provide an articulated lever cutting and forming press of the type described at the outset, in which the working range of the slide is adjustable within relatively wide limits regardless of the slide travel and while maintaining unrestricted slide guidance, and in which the stand structure minimizes the spring mounting of the press stand to almost zero in the interests of high cutting accuracy, large presses being of particular interest in this context.

In achieving this object according to the invention, it is intended that the press stand is a twin-stand frame partially closed even at the front and end, that the working range of the slide in the stand can be adjusted by synchronously driven shafts which are held by threaded guides formed in the upper cross-beam of the stand, and furthermore end in the shaft bearings formed at the height-adjustable guide beams provided on both sides of the stand, and that the guide beams are provided, on their lower surfaces, with bearings permitting the suspension of the pair of articulated levers connecting with the slide.

Because the twin-stand frame is partially closed at the front and end, the possiblity of spring mounting is very substantially restricted, and the means used for this purpose will be described subsequently.

The working range of the slide is adjusted by means of the shafts which are supported by the stand and which, as a rule, are driven synchronously by electric motor and which end in bearings formed on the guide beams. The second series of bearings arranged on the lower surface of the guide beams serves to connect the said beams, via the pair of articulated levers, to the slide.

The slide drive will be described subsequently.

Regarding the further structure of the stand and of the guide beams, it is noted that the guide beams, whose height is adjustable, are connected to a slide plate which is arranged in a guide bed formed on a bearing and supporting wall closing the rear of the stand, and to a slide plate which is arranged in a guide bed formed on a bearing and supporting wall closing the front of the stand, the bearing and supporting walls being rigidly—and firmly or detachably—connected to the stand, and that guides for correspondingly engaging the lateral guides detachably but rigidly connected to the bearing and supporting wall are provided at the lateral limits of the slide, and these lateral guides are additionally secured in their position against the stand columns by wedging.

The partial front and rear closure of the press stand, whose static significance has already been mentioned, by means of bearing and supporting walls permits the formation of a vertical guide bed in each of the bearing and supporting walls for arranging the slide plates to be coordinated rigidly with the guide beams, and allows the essential guide means for the slide to be adjusted over the working range simultaneously with the adjustment of the working range. The lateral guides are independent and, as mentioned, are arranged on the stand and secured in their position.

The articulated lever embodiment and the slide drive furthermore envisage that the upper articulated levers arranged on the rocker bearings are connected, at the joints, to the lower articulated levers, which in turn are connected to the lower rocker bearings fastened to the bottom of the slide—and directed toward the bearings formed on the lower surface of the guide beams—the articulated levers being connected in a known manner via the connecting rods to the multi-articulated support guided in the center of the press, and furthermore via the piston rod to the hydraulic cylinder drive connected to the slide.

The multi-articulated support which is guided in the center of the press and is connected on the one hand to the hydraulic cylinder drive connected to the slide, and on the other hand via the connecting rods to the articulated lever system, is guided, independently of the slide, in the center of the press and in the slide plates already mentioned, so that an absolutely exact articulated lever drive independent of the adjustment of the working range, and hence reliable slide drive, are ensured.

Regarding the arrangement of the connecting rods leading to the articulated lever systems, it may be stated that the connecting rods of both articulated lever systems in the central multi-articulated support end in a link pin or in a link pin where a plurality of parts are isoaxial to one another or in two parallel link pins where one or several parts are isoaxial to one another, and, in the case of two parallel link pins, the connecting rods may alternatively be crossed.

The embodiment which is usually most expedient is an arrangement of the connecting rods so that they are parallel and isoaxial to one another on link pins or shafts which are mounted in the multi-articulated support. The upper articulated levers arranged on the guide beams can be combined with the same number "n" of connecting rods and with "n-1" lower articulated levers.

It is also proposed that the upper articulated levers be fork-shaped at their ends aligned for articulated connection to the connecting rods.

For dimensioning the rear bearing and support wall, it is proposed that the distance between the upper limit of the press table and the lower limit of the rear bearing and supporting wall slightly exceeds the sum of the height of the tool and the travel.

The embodiment of a press having two slides envisages that two slides operating by the opposed cylinder method are arranged in a twin stand in the form of an upright stand; in the case of vertical orientation of the twin stand, the slide operating from below is lengthened by a small amount which takes into account the required passage through the press table, with an otherwise identical form to the upper slide.

The slides operating by the opposed cylinder method require special care with regard to control.

It is envisaged that the upper and lower hydraulic cylinder drives for the slides are connected hydromechanically to one another via a regulating element, and digitally programmable and monitoring ultrasonic displacement transducers can be assigned to the regulating element. To keep the press table in a normal working position, the twin stand is provided on both sides with support claws for its partial underfloor mounting.

An articulated lever cutting and forming press based on these principles fully achieves the object.

The invention is illustrated by the attached schematic diagram of an embodiment.

PRELIMINARY REMARKS

To permit better comprehension, the item numbers have been assigned an additional digit which is separated by a point and classifies the assembly as such.

The additional digits have the following meanings:

1. The embodiment of the stand and table including the guide parts rigidly connected, or detachably and rigidly connected, to this stand;
2. The slide, including the height-adjustable guides connected to it, and the drive elements;
3. An embodiment according to FIG. 7, i.e. the twin frame and its accessories and a regulating element.

Figure 7:
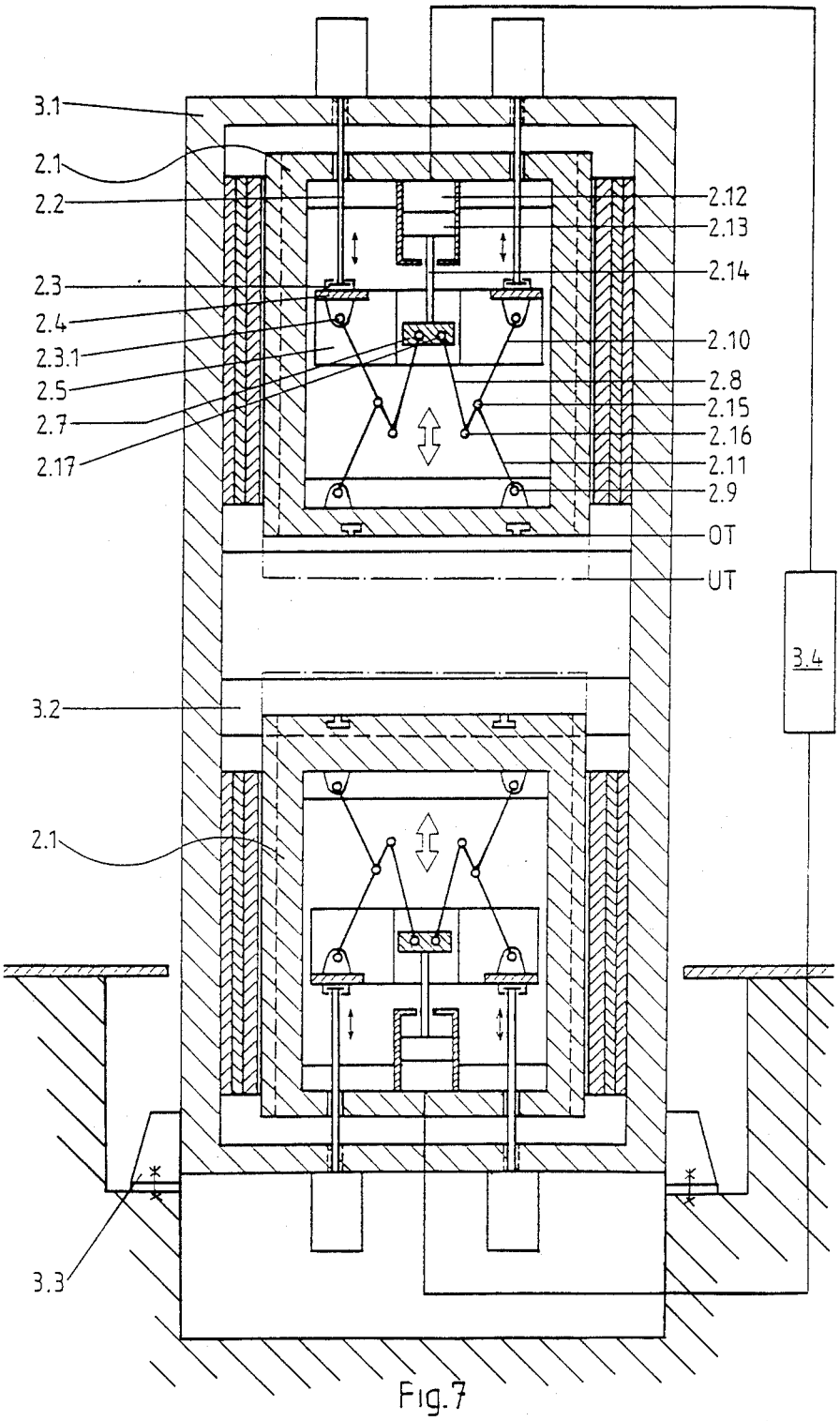
FIG. 7 shows a press equipped with two slides driven in opposite directions.

The positioning of the drive elements is supplemented in FIG. 7 by the items already introduced, with the additional digit 2.

The description is followed by a parts list, classified according to the additional digits.

The press stand 1.1 is closed at the bottom by a baseplate 1.2, the stand columns 1.3, abutting and each being directed inward, form the two lateral edges of the baseplate 1.2, and the stand 1.1 is completed by the connecting upper transverse beams 1.4 in the form of box girders.

In the base area between the stand columns 1.3 the table substructure 1.5 is formed, which is bordered above by the press table plate 1.6 lying on top.

The stand columns 1.3 are connected in their upper region—flush with their height—by the rear bearing and supporting wall 1.7. A vertical guide bed 1.7.1 for holding the rear slide plate 2.5 is formed on this plate. The bearing and supporting wall 1.7 is relatively thick and ribbed at the back and extends between the stand columns 1.3., in a downward direction, somewhat beyond the height of the adjusting and working range of the slide 2.1. At the front, the slide 2.1 is likewise bordered by a further bearing and supporting wall 1.8 which is detachably arranged a distance away from the upper stand edge and which in turn is provided with a recessed guide bed 1.8.1 for the end slide plate 2.6, the said wall being kept lower in height.

The lateral guides 1.9 arranged on both sides of the slide 2.1 are screwed and pinned to the rear bearing and supporting wall 1.7 and additionally secured in their position by means of the stands 1.3 and wedges 1.10. The threaded guides 1.11 for the shafts 2.2 for the basic setting of the slide 2.1 are formed in the upper transverse beam 1.4, as a rule the threaded shafts being capable of being synchronously motor-driven.

Regarding the embodiment and basic setting of the slide 2.1 forming a closed frame, it is noted that the shafts 2.2 each engage a journal bearing 2.3 formed on a guide beam 2.4 of adjustable height, while the bearings 2.3.1 for suspending the articulated lever systems are provided underneath the guide beams on both sides. The guide beams 2.4 are connected to the slide plates 2.5 and 2.6 which can be introduced into the guide bed 1.7.1 and 1.8.1, this connection generally being a screw or pin connection.

The hydraulic cylinder drive 2.12 consisting of piston 2.13 and piston rod 2.14 engages, through the piston rod 2.14, the central multi-articulated supports 2.7, to which the connecting rods 2.8 are connected by link pins 2.17.

Rocker bearings 2.9 are provided in rows on the slide base directed toward the height-adjustable guide beams 2.4, the said rocker bearings holding the articulated lever systems arranged on the guide beams 2.4 or on the bearings 2.3.1 connected to them. The articulated lever systems consist of the upper articulated levers 2.10 assigned to the guide beams 2.4, and the articulated levers 2.11 connected by an articulated coupling to the lower row of rocker bearings 2.9. They are connected by the articulated levers 2.15, the connecting rods 2.8 engaging each of the projecting ends of the upper articulated levers 2.10, via fork joints 2.16.

The articulated lever systems fold inward, i.e. toward one another. On the rear panel of the stand 1.1, i.e. on the rear bearing and supporting wall 1.7, a supporting frame can be provided for holding a hydraulic fluid container.

As already mentioned but formulated in a different way, the distance between the lower limit of the rear bearing and supporting wall 1.7 and the upper limit of the press table 1.6 should merely correspond to the tool height plus the travel of the slide 2.1, i.e. should be as small as possible, in order that, in conjunction with the slide design and the arrangement of the articulated levers in the slide 2.1, spring mounting of the stand 1.1 is minimized, and, by allround guidance of the slide 2.1, consisting of the readjustable lateral guides 1.9 arranged on both sides, the slide plate 2.5 guided in the bearing and supporting wall 1.7, and the slide plate 2.6 guided in the end bearing and supporting plate 1.8, in conjunction with the guidance, likewise effected by the two slide plates 2.5 and 2.6, of the central multi-articulated support 2.7 driven by the piston rod 2.14, a frame spring mounting approaching zero is achieved.

In addition, reference must be made to the drive system employed, which is known per se and which envisages that the travel of the drive, i.e. of the hydraulic cylinder drive 2.12 connected to the slide, is equal to the travel of the connecting joint, i.e. of the central multi-articulated support 2.7, minus the travel of the slide 2.1. This results in a reduction of the hydraulic fluid required and its operating volume during pressure relief, which is reflected in a substantial reduction in the cutting impact noise.

Figure 4:
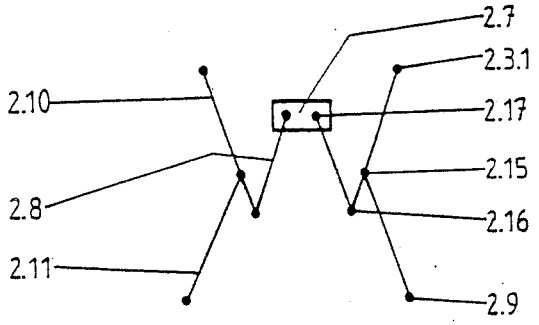
FIG. 4 shows a two-sided connecting rod arrangement with parallel axes on the central multi-articulated support.
Figure 5:
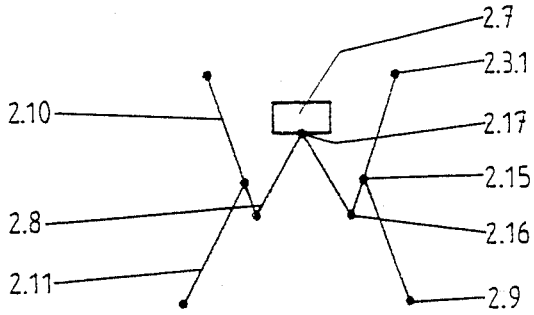
FIG. 5 shows a uniaxial connecting rod arrangement on the central multi-articulated support.
Figure 6:
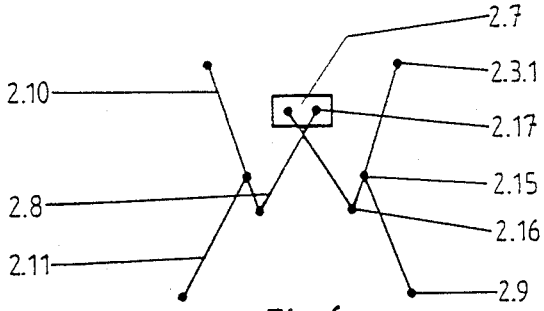
FIG. 6 shows a two-sided connecting rod arrangement with parallel axes on the central multi-articulated support with crossed connecting rods.

Regarding FIGS. 4 to 6, reference may be made to the legend, the individual parts being positioned in accordance with the items from the dual group.

Hence, the following positions are obtained: 2.7 multi-articulated support, 2.8 connecting rod, 2.10 upper articulated levers, 2.11 lower articulated levers, 2.15 joints, 2.16 fork joint for engagement of connecting rod 2.8 with the upper articulated levers 2.10.

Figure 1:
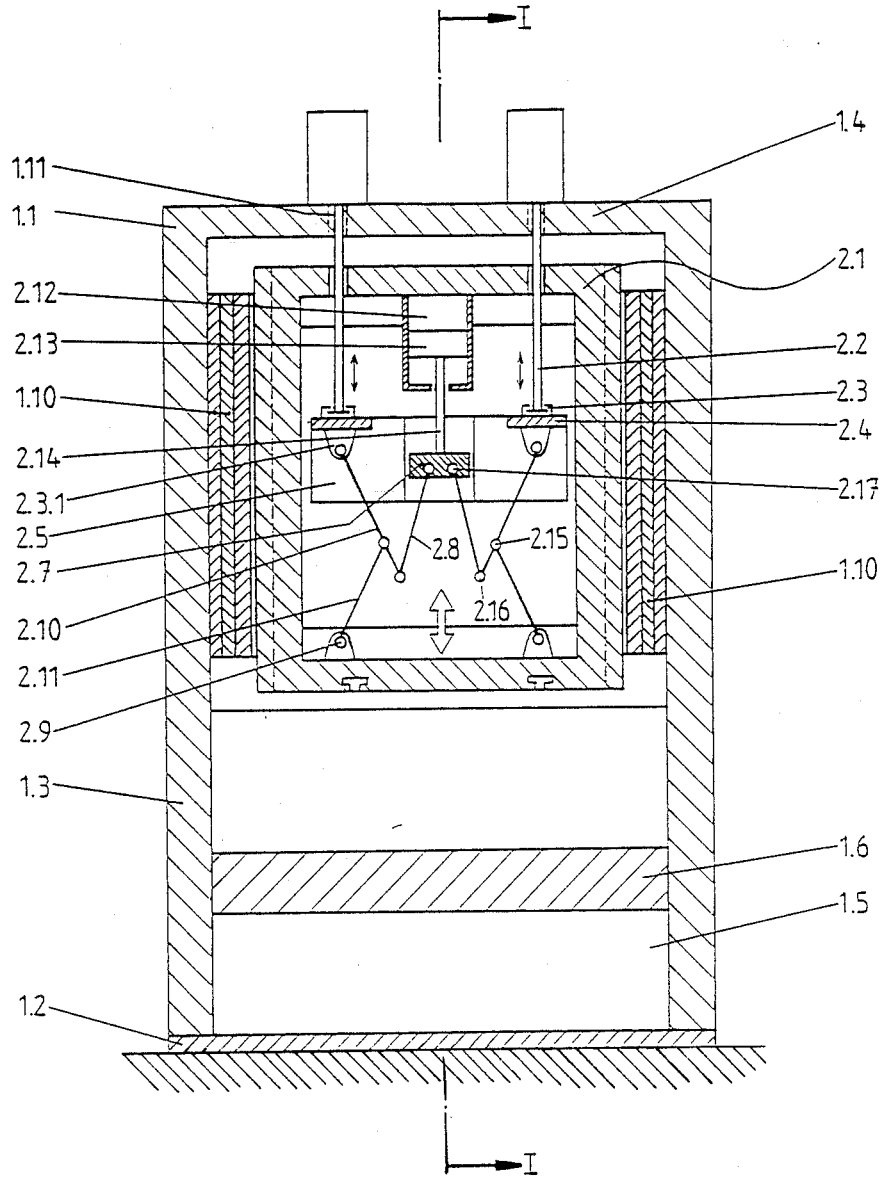
FIG. 1 shows the embodiment of the slide in conjunction with the stand in a cross-section II—II from FIG. 2.
Figure 2:
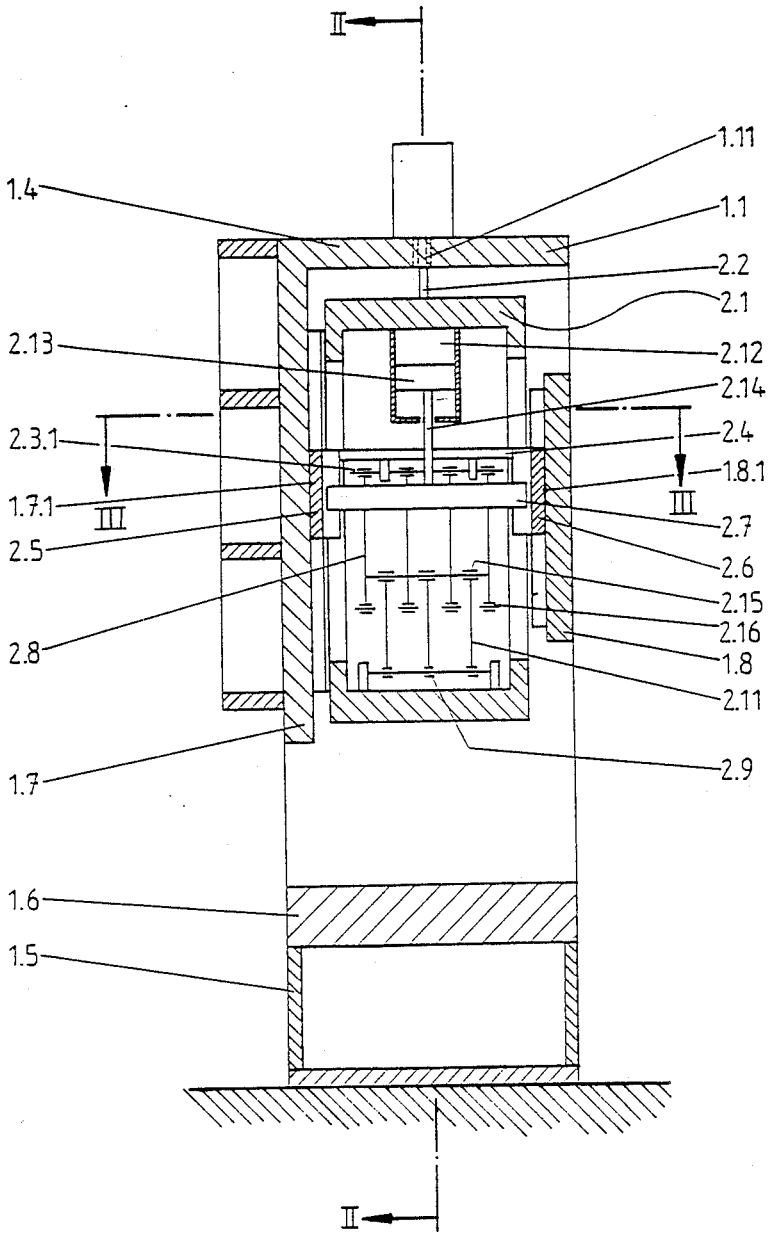
FIG. 2 shows the cross-section I—I from FIG. 1, which passes through the side elevation.
Figure 3:
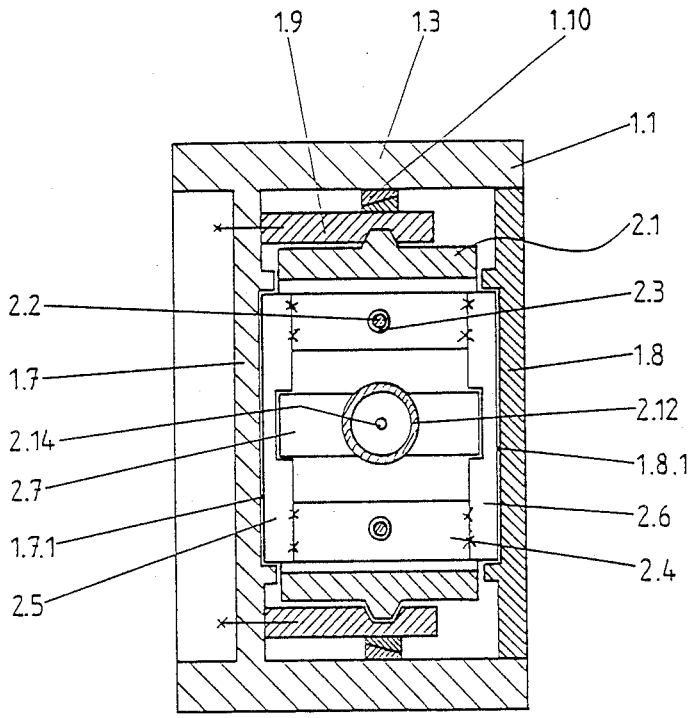
FIG. 3 shows a cross-section III—III through FIG. 2.

In the double press according to FIG. 7, the hydraulic cylinder drives 2.12 are arranged opposite one another, i.e. at the top and at the bottom, in the slide 2.1, the further design of the slide for the top and bottom corresponding to FIGS. 1 to 3 and the statements relating to these FIGS.

In contrast, the lower press slide 2.1 is lengthened in order to be able to take into account the thickness of the press table 3.2 when the slide 2.1 passes through to the upper dead center. The twin frame 3.1 is fastened on support claws 3.3 in a machine pit so that a normal table level is obtained.

A regulating element 3.4 is provided for hydromechanical connection of the upper and lower hydraulic cylinder drives.

LIST OF PARTS

1. Stand and table, including the guide parts rigidly connected, or detachably and rigidly connected to the stand
1.1 Stand
1.2 Baseplate
1.3 Stand columns
1.4 Upper transverse beam
1.5 Table substructure
1.6 Press table plate
1.7 Bearing and supporting wall, rear
1.7.1 Guide bed for the rear slide plate 2.5
1.8 Front bearing and supporting wall
1.8.1 Guide bed for the end slide plate 2.6
1.9 Lateral guides
1.10 Secured wedges
1.11 Threaded guide for the shafts 2.2
2. Slide, including the height-adjustable guides connected to this slide, and the drive elements
2.1 Slide
2.2 Shafts for the basic setting (height)
2.3 Shaft bearings
2.3.1 Bearing for suspending the articulated lever systems
2.4 Height-adjustable guide beams
2.5 Rear slide plate
2.6 Front slide plate
2.7 Central multi-articulated support
2.8 Connecting rod
2.9 Row of rocker bearings on bottom of slide
2.10 Upper articulated levers arranged on the guide beams 2.4

2.11 Lower articulated levers arranged on the row of rocker bearings 2.9
2.12 Hydraulic cylinder drive
2.13 Piston
2.14 Piston rod, engaging the multi-articulated support 2.7
2.15 Joints
2.16 Fork joints
2.17 Link pins, arranged in multi-articulated support 2.7
3.1 Twin frame
3.2 Press table
3.3 Support claws
3.4 Regulating element for the hydromechanical connection of upper and lower hydraulic cylinder drives

I claim:

1. An articulated lever cutting and forming press consisting of a press stand and a generally closed, frame-shaped press slide, the slide possessing—in each case between two symmetrically identical articulated lever systems which fold with their joints toward the center of the press—a hydraulic cylinder drive which is arranged on the slide and whose piston is connected at the end of its piston rod to the multi-articulated support guided in the center of the press in the slide and at least two connecting rods are movably arranged on the said multi-articulated support and their other ends engage the articulated lever systems, which in turn on the one hand are arranged on the press frame so that their height can be adjusted and on the other hand are rotatably mounted in the slide, directed toward a press table, the hydraulic cylinder drive obeying the relationship that the travel of the piston is equal to the travel of the multi-articulated support minus the travel of the slide wherein the press stand is a twin-stand frame partially closed even at the front and end, the working range of the slide in the stand is adjustable by synchronously driven shafts which are supported by threaded guides formed in an upper transverse beam of the stand, and furthermore end in shaft bearings formed on guide beams whose height can be adjusted and which are provided on both sides of the stand, and the guide beams are provided on their lower surface with bearings for the suspension of the pair of articulated levers which are connected to the slide.

2. An articulated lever cutting and forming press as claimed in claim 1, wherein the guide beams whose height can be adjusted are connected to a slide plate which is arranged in a guide bed formed on a bearing and supporting wall closing the rear of the stand, and to a slide plate which is arranged in a guide bed formed on a bearing and supporting wall closing the front of the stand, the bearing and supporting walls being rigidly connected to the stand, and guides for the corresponding engagement of the lateral guides detachably but rigidly connected to the bearing and supporting wall are provided at the lateral limits of the slide, and these lateral guides are additionally secured against the stand columns by wedging.

3. An articulated lever cutting and forming press as claimed in claim 1, wherein upper articulated levers arranged on rocker bearings are connected, at the joints to lower articulated levers, which in turn are connected to lower rocker bearings fastened to the bottom of the slide—and directed toward the bearings formed on the lower surface of the guide beams—the articulated levers or the joints being connected via the connecting rods to the multi-articulated support guided in the center of the press, and furthermore via the piston rod to the hydraulic cylinder drive connected to the slide.

4. An articulated lever cutting and forming press as claimed in claim 1, wherein the connecting rods of both articulated lever systems on the central multi-articulated support end in a link pin.

5. An articulated lever cutting and forming press as claimed in claim 1, wherein the upper articulated levers can be combined with the same number "n" of connecting rods and with "n-1" lower articulated levers.

6. An articulated lever cutting and forming press as claimed in claim 1, wherein upper articulated levers are fork-shaped at their ends aligned for articulated connection with the connecting rods.

7. An articulated lever cutting and forming press as claimed in claim 1, wherein the distance between the upper limit of a press table and the lower limit of the rear bearing and a supporting wall slightly exceeds the sum of the height of the tool and the travel.

8. An articulated lever cutting and forming press as claimed in claim 1, wherein two slides operating by an opposed cylinder method are arranged in a twin stand in the form of a vertical stand.

9. An articulated lever cutting and forming press as claimed in claim 8, wherein, when the twin stand is oriented vertically, the slide operating from below is lengthened by a small amount which takes into account the required passage through a press table, with otherwise identical design to an upper slide.

10. An articulated lever cutting and forming press as claimed in claim 9, wherein upper and lower hydraulic cylinder drives for the slides are connected hydromechanically to one another via a regulating element, and digitally programmable and monitoring ultrasonic displacement transducers can be assigned to the regulating element.

11. An articulated lever cutting and forming press as claimed in claim 8, wherein the twin stand is provided on both sides with supporting claws for its partial underfloor mounting.

* * * * *